US006435512B1

(12) United States Patent
Beckwith, Sr.

(10) Patent No.: US 6,435,512 B1
(45) Date of Patent: Aug. 20, 2002

(54) PORTABLE TARGET STAND AND TARGET

(76) Inventor: James C. Beckwith, Sr., 5402 E. Gamble Quail Pl., Sierra Vista, AZ (US) 85635

( * ) Notice: Subject to any disclaimer, the term of this patent is extended or adjusted under 35 U.S.C. 154(b) by 0 days.

(21) Appl. No.: 09/552,002

(22) Filed: Apr. 19, 2000

(51) Int. Cl.[7] ..... F41J 1/10
(52) U.S. Cl. ..... 273/407; 273/403
(58) Field of Search ..... 273/398–402, 273/403, 404, 407, 408; 473/197

(56) References Cited

U.S. PATENT DOCUMENTS 271,647 A * 2/1883 Medart ..... 273/400
2,932,516 A * 4/1960 Penner ..... 273/402
3,743,286 A * 7/1973 Weinhagen et al. ..... 273/407
4,239,236 A * 12/1980 Parham et al. ..... 273/403
4,546,984 A * 10/1985 Towle ..... 273/404
4,553,751 A * 11/1985 Ketchum ..... 273/407
5,678,824 A * 10/1997 Fortier ..... 273/407
5,725,217 A * 3/1998 White ..... 273/407
5,938,203 A * 8/1999 Beckwith, Sr. ..... 273/407
5,979,899 A * 11/1999 Wilson ..... 273/407

* cited by examiner

*Primary Examiner*—Mark S. Graham

(57) ABSTRACT

A portable target stand and target for target practice includes an upper rectangular support fabricated of polyvinyl chloride pipes in a rectangular configuration and a target in a square configuration. A plurality of holes are provided through the target. Each hole has a sleeve with a flange on one end for positioning over the front face of the target. Each of the pipes is fabricated of hollow polyvinyl chloride with a central aperture there through for alignment with holes in the target with bolts for coupling. A base assembly has an interior horizontal pipe and an exterior horizontal pipe on each side in spaced parallel relationship; and a central brace with a lower end removably affixed to a lower attachment component which is fixedly secured to the center of the upper horizontal pipe which receives the target with the central brace constituting an effective hypotenuse of a triangle.

4 Claims, 6 Drawing Sheets

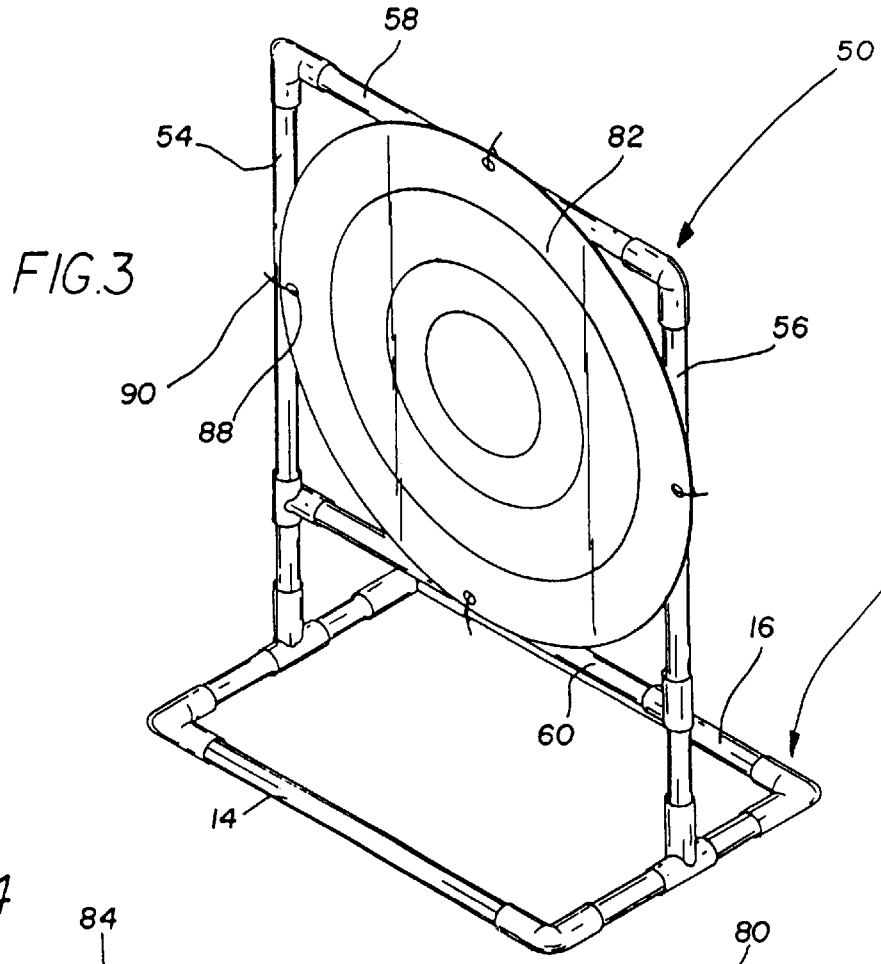
FIG.3
FIG.4
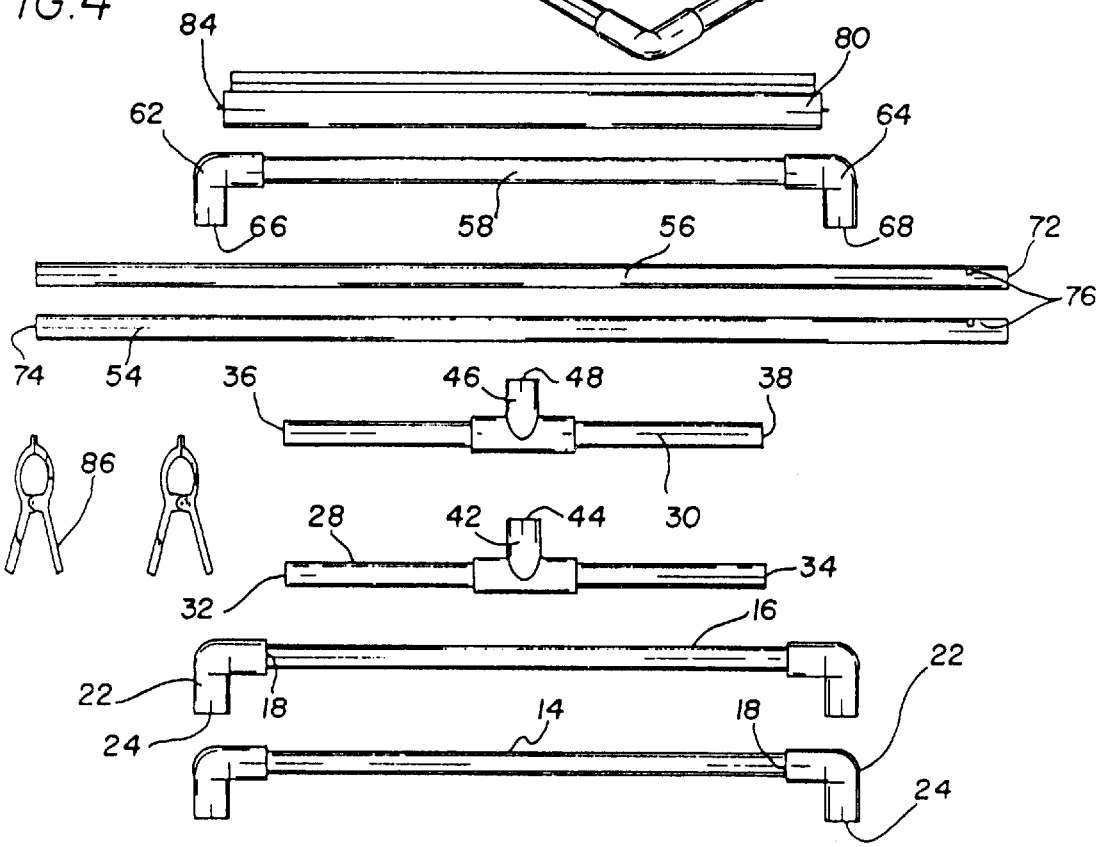

PORTABLE TARGET STAND AND TARGET

BACKGROUND OF THE INVENTION

1. Field of the Invention

The present invention relates to a portable target stand and target and more particularly pertains to providing a portable target stand for holding targets of various types.

2. Description of the Prior Art

The use of a portable target is known in the prior art. More specifically, portable targets heretofore devised and utilized for the purpose of target practice are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,209,492 to Hamilton discloses a shooting target stand. U.S. Pat. No. 5,240,258 to Bateman discloses a versatile pop-up/knock-down target system. U.S. Pat. No. 4,813,684 to Bruno discloses a target for a bow and arrow. U.S. Pat. No. 4,029,318 to Boss discloses a portable and adjustable target stand. U.S. Pat. No. 4,726,593 to Wade discloses a portable target assembly. Lastly, U.S. Pat. No. Des. 335,311 to Robinson discloses a target support.

In this respect, the portable target stand and target according to the present invention substantially departs from the conventional concepts and designs of the prior art, and in so doing provides an apparatus primarily developed for the purpose of providing a portable target stand for holding targets of various types.

Therefore, it can be appreciated that there exists a continuing need for a new and improved portable target stand and target which can be used for providing a portable target stand for holding targets of various types. In this regard, the present invention substantially fulfills this need.

SUMMARY OF THE INVENTION

In view of the foregoing disadvantages inherent in the known types of portable targets now present in the prior art, the present invention provides an improved portable target stand and target. As such, the general purpose of the present invention, which will be described subsequently in greater detail, is to provide a new and improved portable target stand and target which has all the advantages of the prior art and none of the disadvantages.

To attain this, the present invention essentially comprises an upper rectangular support fabricated of polyvinyl chloride pipes formed in a rectangular configuration. A target is provided. The target is fabricated of polyfoam in a square configuration with a thickness of about between 2 and 4 inches. A plurality of holes are provided through the target. Each hole has a stainless steel sleeve with a flange on one end for positioning over the front face of the target. Each of the pipes is fabricated of hollow ¾-inch polyvinyl chloride. Each of the pipes has a central aperture there through for alignment with holes in the target. Bolts are provided through the holes for coupling purposes. A pair of sand bags are next provided. The sand bags are positionable on the forward extent and rearward extent of the horizontal base. The sand bags function to preclude inadvertent tipping of the support and target. A bag is next provided. The bag has an opening at one end and an adjacent tie string. The bag is adapted to receive and support the frame when disassembled for storage and transportation purposes.

Lastly, a base assembly is provided. The base assembly includes an interior horizontal pipe and an exterior horizontal pipe on each side in spaced parallel relationship. The base assembly has a T-shaped coupler. The T-shaped coupler retains the horizontal pipes of each side in linear relationship. The base assembly also has an end horizontal cross pipe. The end horizontal pipe couples the ends of the exterior horizontal pipes. Elbows are provided to couple the end horizontal cross pipe and exterior horizontal pipes. The base assembly also has an intermediate horizontal cross piece. The interior and exterior horizontal pipes are coupled through T-shaped couplers. Elbows at the interior ends of the interior horizontal pipes couple to the vertical pipes. A central brace has a lower end removably affixed to a lower attachment component which is, in turn, fixedly secured, preferably by glue, to the center of the end horizontal cross piece. The upper end of the central brace is removably affixed to an upper attachment component. The upper attachment component is, in turn, fixedly secured, preferably by glue, to the center of the upper horizontal pipe which receives the target. The central brace constitutes an effective hypotenuse of an isosceles right triangle with angles of about 45 degrees with the horizontal and vertical pipes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable target stand and target which has all the advantages of the prior art portable targets and none of the disadvantages.

It is another object of the present invention to provide a new and improved Portable target stand and target which may be easily and efficiently manufactured and marketed.

It is a further object of the present invention to provide a new and improved portable target stand and target which is of a durable and reliable construction.

An even further object of the present invention is to provide a new and improved Portable target stand and target which is susceptible of a low cost of manufacture with regard to both materials and labor, and which accordingly is then susceptible of low prices of sale to the consuming public, thereby making such Portable target stand and target economically available to the buying public.

Still yet another object of the present invention is to provide a new and improved portable target stand and target which provides some of the advantages of the apparatuses and methods of the prior art while simultaneously overcoming some of the disadvantages normally associated therewith.

Still another object of the present invention is to provide a portable target stand for holding targets of various types.

Lastly, it is an object of the present invention to provide a new and improved portable target stand and target for target practice including an upper rectangular support fabricated of polyvinyl chloride pipe in a rectangular configuration and a target in a square configuration. A plurality of holes are provided through the target. Each hole has a sleeve with a flange on one end for positioning over the front face of the target. Each of the pipes is fabricated of hollow polyvinyl chloride pipe with a central aperture there through for alignment with holes in the target. Bolts effect the coupling. A base assembly has an interior horizontal pipe and an exterior horizontal pipe on each side in spaced parallel relationship; a T-shaped coupler retaining the horizontal pipes of each side in linear relationship; an end horizontal cross pipe coupling the ends of the exterior horizontal pipes with elbows effecting the coupling therebetween; an intermediate horizontal cross piece coupling the interior and exterior horizontal pipes through T-shaped couplers with elbows at the interior ends of the interior horizontal pipes coupling to the vertical pipes; and a central brace with a lower end removably affixed to a lower attachment component which is, in turn, fixedly secured to the center of the end horizontal cross piece with the upper end of the central brace removably affixed to an upper attachment components which is in turn fixedly secured to the center of the upper horizontal pipe which receives the target with the central brace constituting an effective hypotenuse of a triangle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric view of the portable target stand and a bull's-eye target of the present invention.

FIG. 4 is a top plan view of the disassembled target stand of the present invention.

Similar reference characters refer to similar parts throughout the several views of the drawings.

DESCRIPTION OF THE PREFERRED EMBODIMENT

Figure 1:
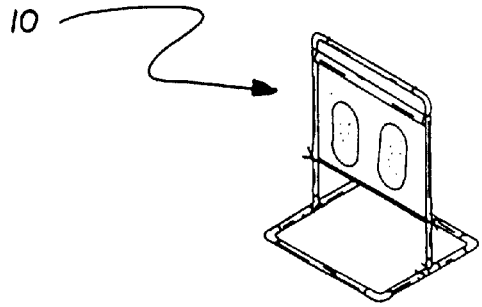
FIG. 1 is a perspective illustration of the preferred embodiment of the portable target stand and target constructed in accordance with the principles of the present invention.

With reference now to the drawings, and in particular to FIG. 1 thereof, a new and improved portable target stand and target embodying the principles and concepts of the present invention and generally designated by the reference numeral 10 will be described.

The present invention, the new and improved Portable target stand and target, is comprised of a plurality of components. Such components in their broadest context include a base portion, a framed upright portion and a target. Such components are individually configured and correlated with respect to each other so as to attain the desired objective.

Figure 2:
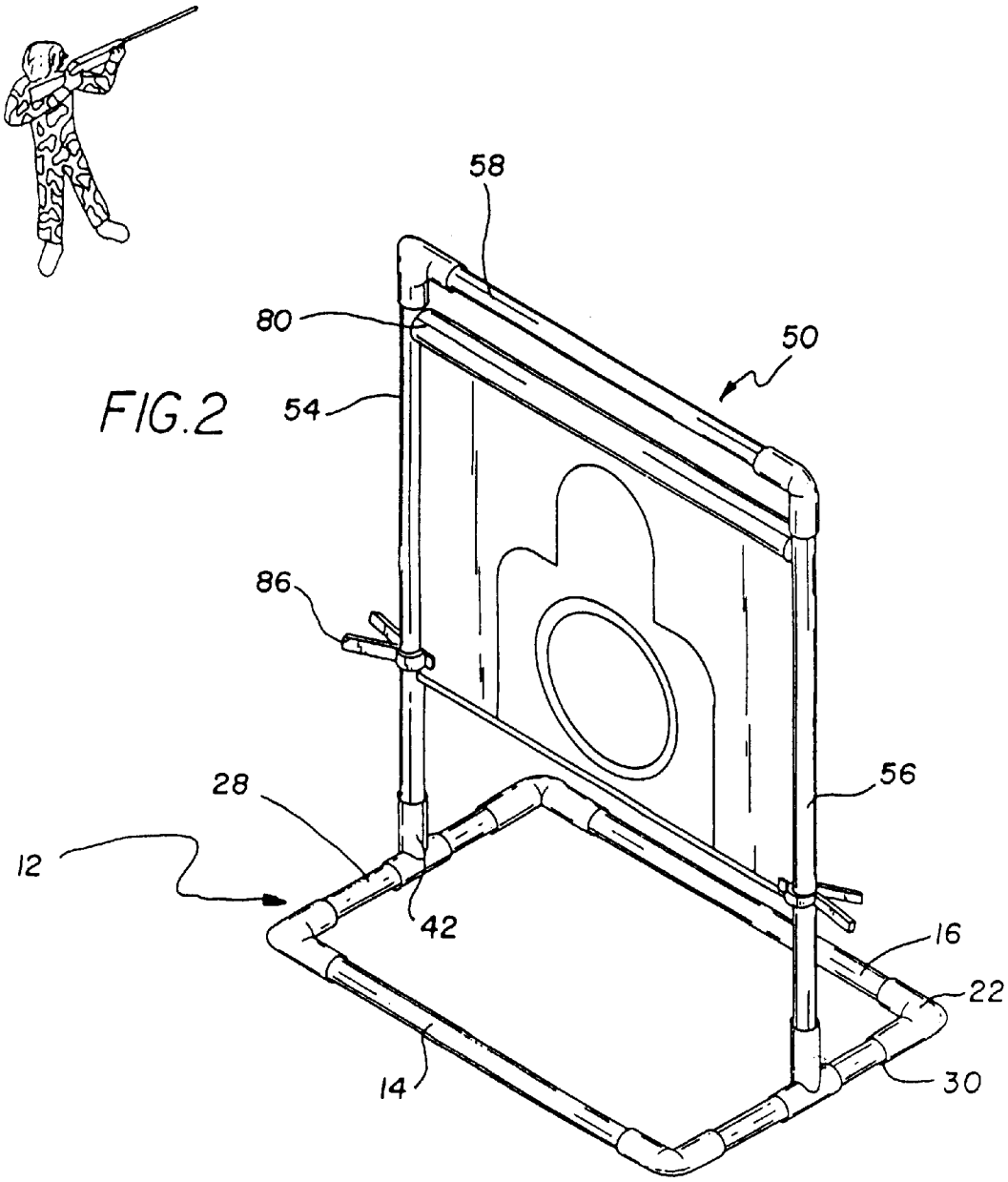
FIG. 2 is an isometric view of the portable target stand and a retractable target of the present invention.

More specifically, the present invention includes a generally rectangular base portion 12, as seen in FIG. 2. The base portion has a pair of elongated bottom supports and a pair of T-supports. The pair of elongated bottom supports form a first bottom support 14 and a second bottom support 16. FIG. 4 shows the first bottom support and the second bottom support each have an pair of ends 18 with each end having an elbow joint 22 fixedly attached. Each elbow joint of each end of each of the pair of bottom supports has a free end 24.

The pair of T-supports forming a first T-support 28 and a second T-support 30. The first T-support has a first end 32 and a second end 34. The second T-support has a first end 36 and a second end 38. The first end of the first T-support is releasably coupled with the free end of one of the elbow joints of the first bottom support 14. The second end of the first T-support is releasably coupled with the free end of one of the elbow joints of the second bottom support 16. The first end of the second T-support is releasably coupled with the free end of another of the elbow joints of the first bottom support 14. The second end of the second T-support is releasably coupled with the free end of another of the elbow joints of the second bottom support 16. The first and second elongated bottom supports are in a parallel orientation, as shown in FIG. 3, when coupled with the first and second T-supports.

Also, the first T-support has a first center projection 42 that defines an first opening 44. The second T-support has a second center projection 46 that defines a second opening 48. The first center projection extends upwardly from the first T-support. The second center projection extends upwardly from the second T-support.

Also, a framed upright portion 50 is provided. As illustrated in FIG. 2, the framed upright portion is formed by a pair of elongated side arms 54 and 56, and an upper support pipe 58. Is may be structured with or without a cross pipe 60. As illustrated in FIG. 4, the upper support pipe has a first upper elbow joint 62 and a second upper elbow joint 64. The first upper elbow joint has a first free end 66 and the second upper elbow joint has a second free end 68.

The pair of elongated side arms form a first side arm 54 and a second side arm 56. Each side arm has an upper free end 72 and a lower free end 74. Each of the pair of elongated side arms has a receiving slot 76. The receiving slot is spaced from the upper free end of each of the side arms, as shown in FIG. 4. The upper free end of the first side arm is sized for releasable coupling with the first upper elbow joint of the upper support pipe. The upper free end of the second side arm is sized for releasable coupling with the second upper elbow joint of the upper support pipe.

Additionally, the lower free end of the first side arm is releasably positioned within the first opening 44 of the first center projection of the first T-support. The lower free end of the second side arm is releasably positioned within the second opening 48 of the second center projection of the second T-support. The first side arm and the second side arm each support the upper support pipe in a plane above the base portion, when they are positioned within the first and second center projection.

Lastly, a target member is provided. The target member may be a retractable target member 80 or a bull's-eye 82. FIGS. 1 and 2 show the retractable target member. FIG. 3 shows the bull's-eye target member. The retractable target member functions like a window blind. The retractable target member has a pair of end pins 84. One of each end pin is positioned within one of the receiving slots of the pair of elongated side arms for supporting the retractable target member above the base portion. The retracted target in an extended position, a pair of clips 86 are use to hold it in place.

Furthermore, the bull's-eye target member has a plurality of openings 88 that are proportionately spaced therearound, as seen in FIG. 3. A plurality of ties 90 are provided, with one each looping through one of the openings for coupling the target member to the pair of side arms, the upper support and the cross pipe.

Figure 5:
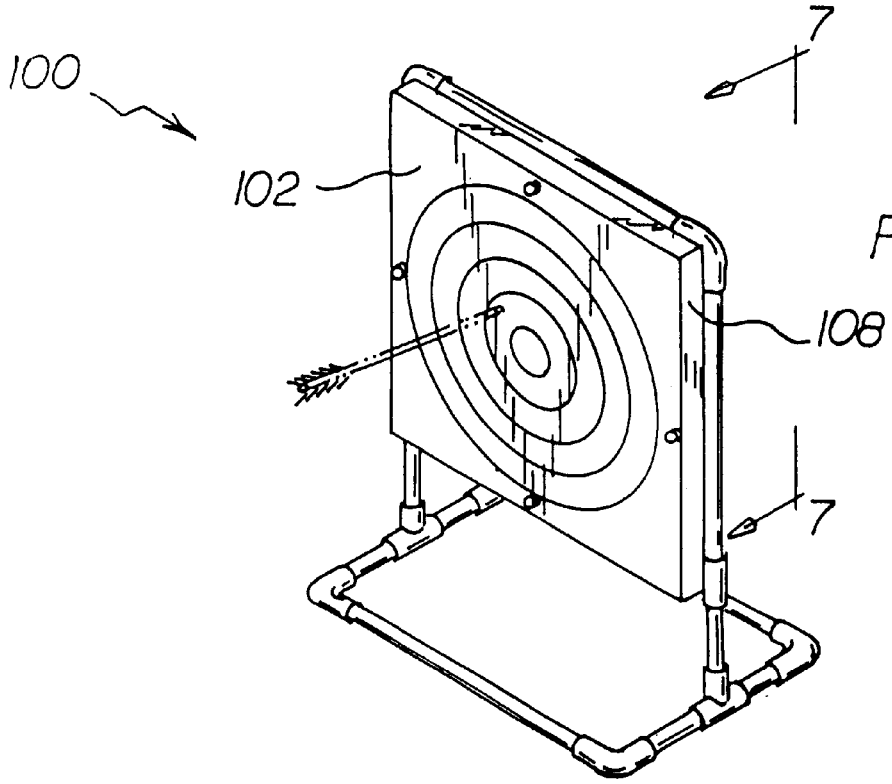
FIG. 5 is a perspective illustration of an alternate embodiment of the invention.
Figure 6:
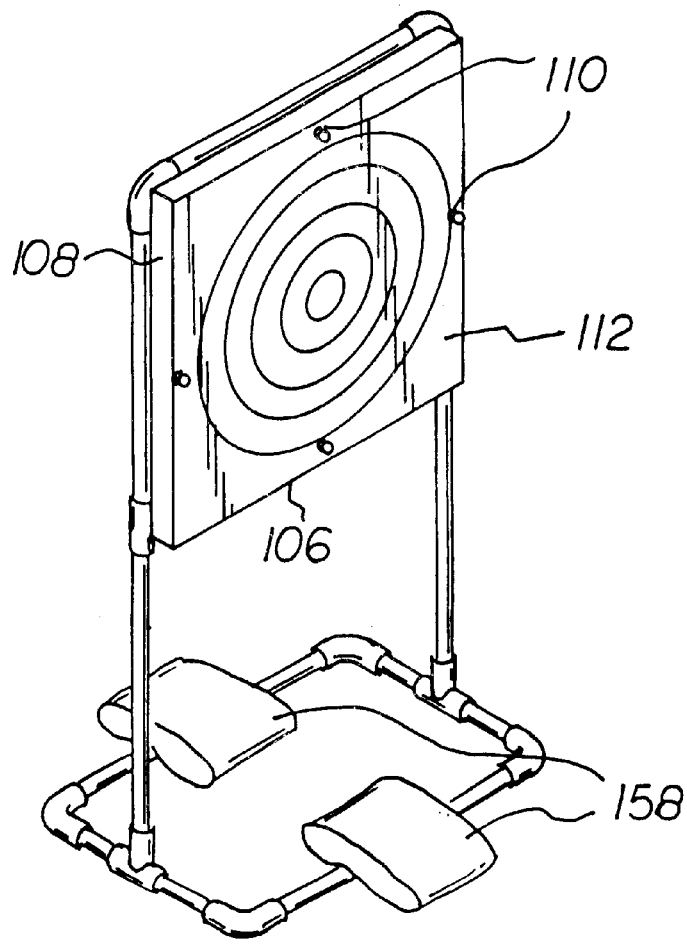
FIG. 6 is a perspective illustration similar to FIG. 5, but showing the sand bags in position.
Figure 7:
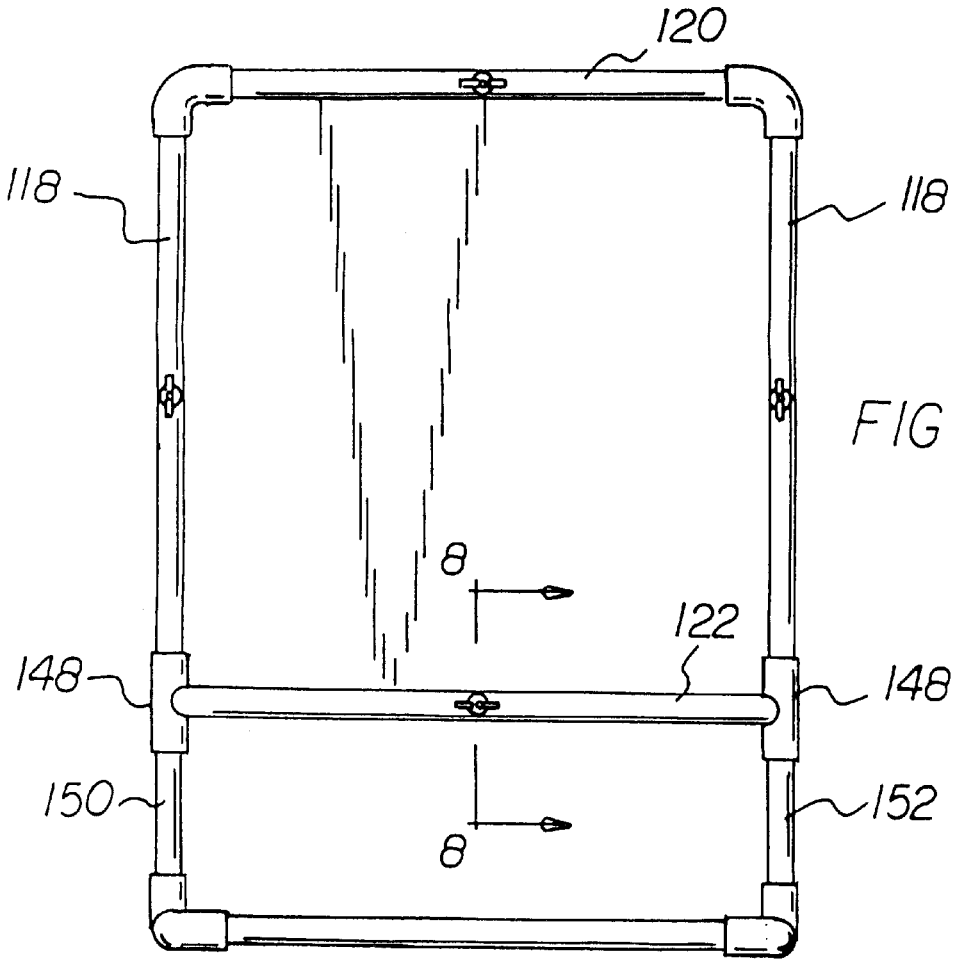
FIG. 7 is a front elevational view taken along Line 7—7 of FIG. 5.

An alternate embodiment of the invention is disclosed in system 100 of FIGS. 5 through 10. In such embodiment, the major difference is the utilization of a different type of target 102. The target of this further embodiment is a rectangular member, preferably square as illustrated in FIGS. 5 and 6. The square has upper and lower horizontal edges 104, 106 in parallel relationship and, coupled there between are vertical side edges 108, parallel with respect to each other. The target has a thickness of at least 2 inches and preferably not greater than 4 inches. It may have any thickness between such 2 and 4 inch dimensions. The preferred material for the target is a commercially available polyfoam. The polyfoam is a generally rigid material with the characteristics that if an arrow is shot there through, the material of the target will return to its original orientation after removal of the arrow. As a result, long life is provided to the system through the use of this novel target material. Support of the target is effected through the utilization of four apertures 110 there through. The apertures extend from the front face 112 to the rear face 114 and have a constant diameter and length. The apertures are located in proximity to the central extents of the four edges of the target. The size of the target is such that the rear face will have its peripheral area in contact with the front faces of the upper rectangle of the pipes for maximum support. Targets of other shapes, such as rectangular, circular, oval, etc., could readily be utilized.

In order to effect the coupling of the target to the pipes, the pipes, including the upper side pipes 118, and the upper and intermediate pipes 120, 122, are formed with horizontal apertures 124 there through adjacent to their midpoints. Such apertures are in axial alignment with the apertures of the target. The periphery of the target in contact with its associated pipes will effect a strong coupling upon being impacted by an arrow regardless of where the target is hit. The pipes are preferably hollow polyvinyl chloride (PVC), rigid, with a preferred diameter of about ¾ inches. Convenience for assembling and disassembling is enhanced by gluing various components with respect to each other and leaving the other components unglued for fitting together prior to use and for unfitting to achieve disassembly prior to storage. Preferably, the horizontal pipes beneath the sand bags 158 are glued to their adjacent elbows. The ends of vertical pipes 150, 152, 154 are preferably unglued to allow for interchangeability but the T-shaped couplers there beneath are glued at their ends to their adjacent horizontal pipes. The ends of the upper and intermediate pipes 120, 122 are glued to their associated coupling components.

Figure 8:
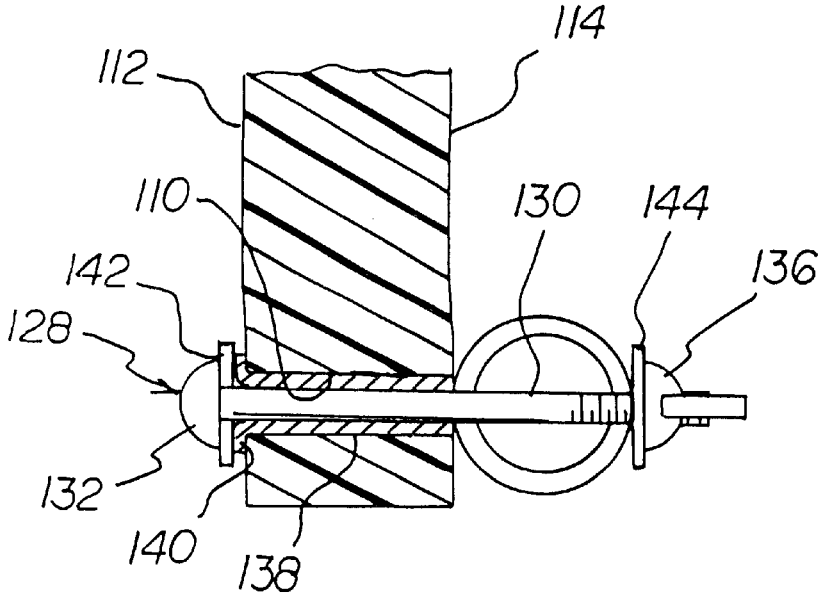
FIG. 8 is a cross-sectional view taken along Line 8—8 of FIG. 7.
Figure 9:
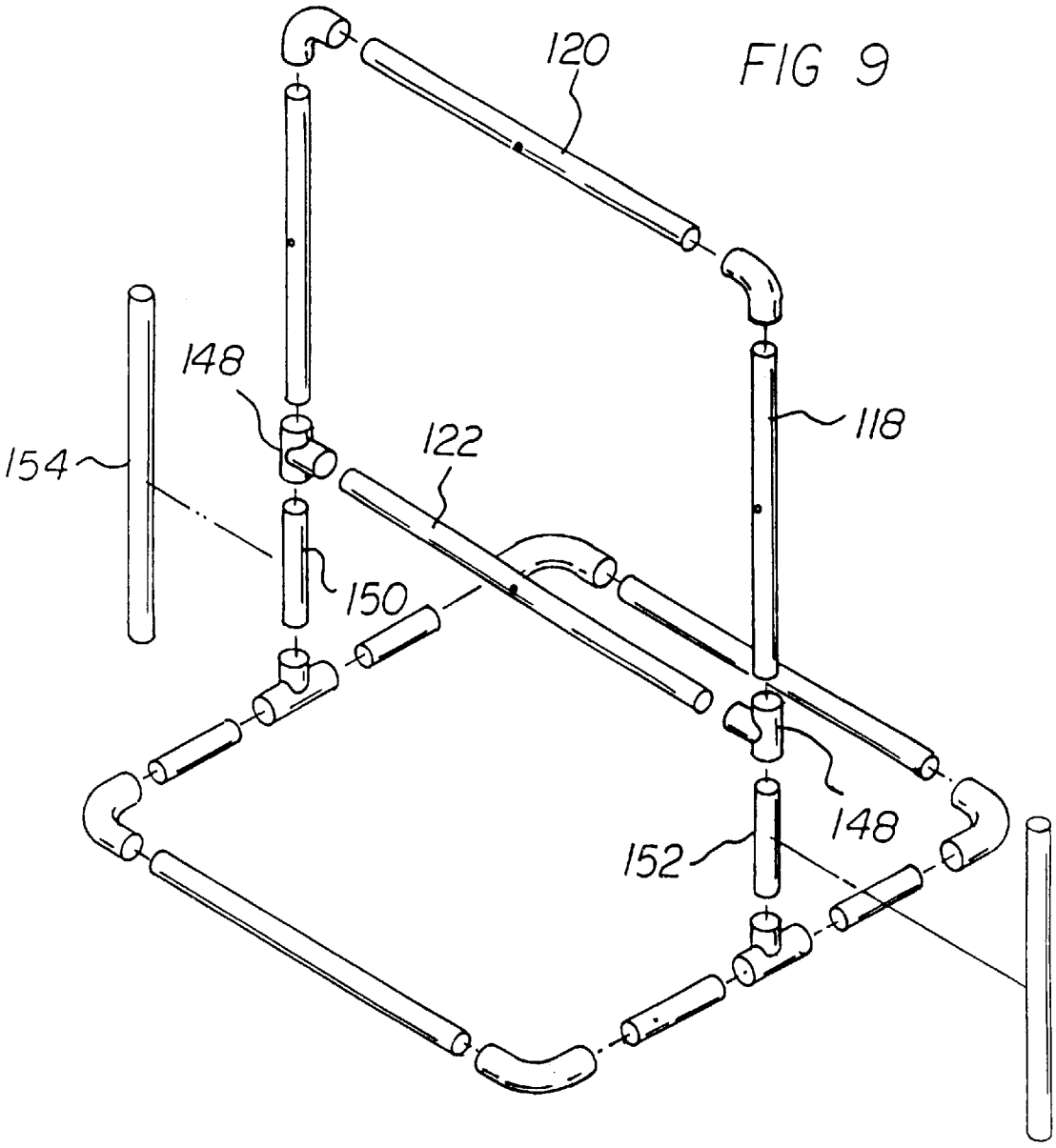
FIG. 9 is an exploded perspective view of the frame.
Figure 10:
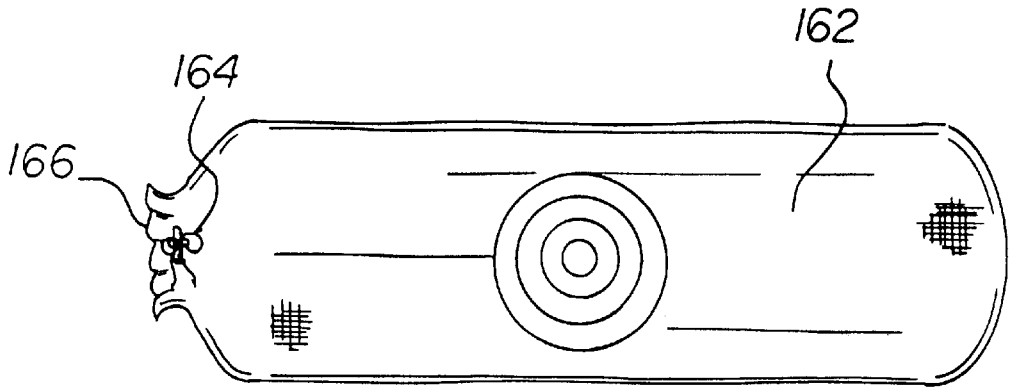
FIG. 10 is a perspective illustration of the support bag for the disassembled frame.

Coupling between the pipes and the target is effected through a coupling assembly 128. The coupling assembly includes a bolt 130 having an enlarged head 132 at one end with threads 134 at the opposite ends. Associated with the threads is a wing nut 136 for coupling and uncoupling purposes. The central extent of each bolt extends through an aperture of the target and the apertures of a pipe, all four in a like manner. Only one is shown in FIG. 8. In association therewith, there is preferably provided a sleeve 138. The sleeve is preferably of stainless steel for long life and is a length essentially equal to the length of the thickness of the target and extends there through. The forward end of the sleeve is provided with a flange 140 adapted to contact the front face of the target. In addition, a pair of washers 142, 144 are employed. One washer is between the head of the bolt and the flange of the sleeve. The other washer is between the wing nut and the associated pipe. The length of the sleeve is equal to the length of thickness of the target and the outside diameter of the sleeve is equal to the inside diameter of the hole in the target. This functions to prevent the bolt from tearing the target.

An additional aspect of the invention is the utilization of central T-shaped couplers 148 adapted to couple spaced vertical pipes 150, 152 supporting the target on opposite sides with the intermediate horizontal pipe 122. In the preferred embodiment, a plurality of vertical lower pipes 150, 152, 154 of varying sizes are provided. In this manner, the pipes 152 of one size may be removed and replaced by pipes 154 of another size. This will allow the raising or lowering of the target and its bullseye for a particular application by a user.

Another additional aspect of the invention is the utilization of sandbags 158. The sandbags are preferably located in contact with the upper surface of the lower rectangular pipe assembly at the forward most extent and at the rearward most extent. Note FIG. 6. In this manner, impact of the target by an arrow will preclude the target from tipping over during operation and use. It is important that the sandbags are filled with sand, not rocks and other debris.

The last feature of the invention is a bag 162. The bag is preferably of a cloth and of a length slightly greater than the length of the longest pole utilized in the assembly. In this manner, the various poles, nuts, bolts, elbow, and the like may be kept together for storage and transportation purposes. A tie string 164 at the open end 166 of the bag allows the positioning of the components within the bag or their removal. The target would, of course, be stored separately from the other components of the system.

The present invention portable target stand and target is a portable, adjustable stand for holding targets. The stand is structured to hold a retractable target and a bull's-eye target.

The stand has a base portion and a framed upright portion. The stand is made out of plastic tubing. The base portion is wide and the four corners are connected with plastic elbow joints. The framed upright portion has a width that is equal to the width of the base portion. Included with the portable stand is a nylon carrying case.

Figure 11:
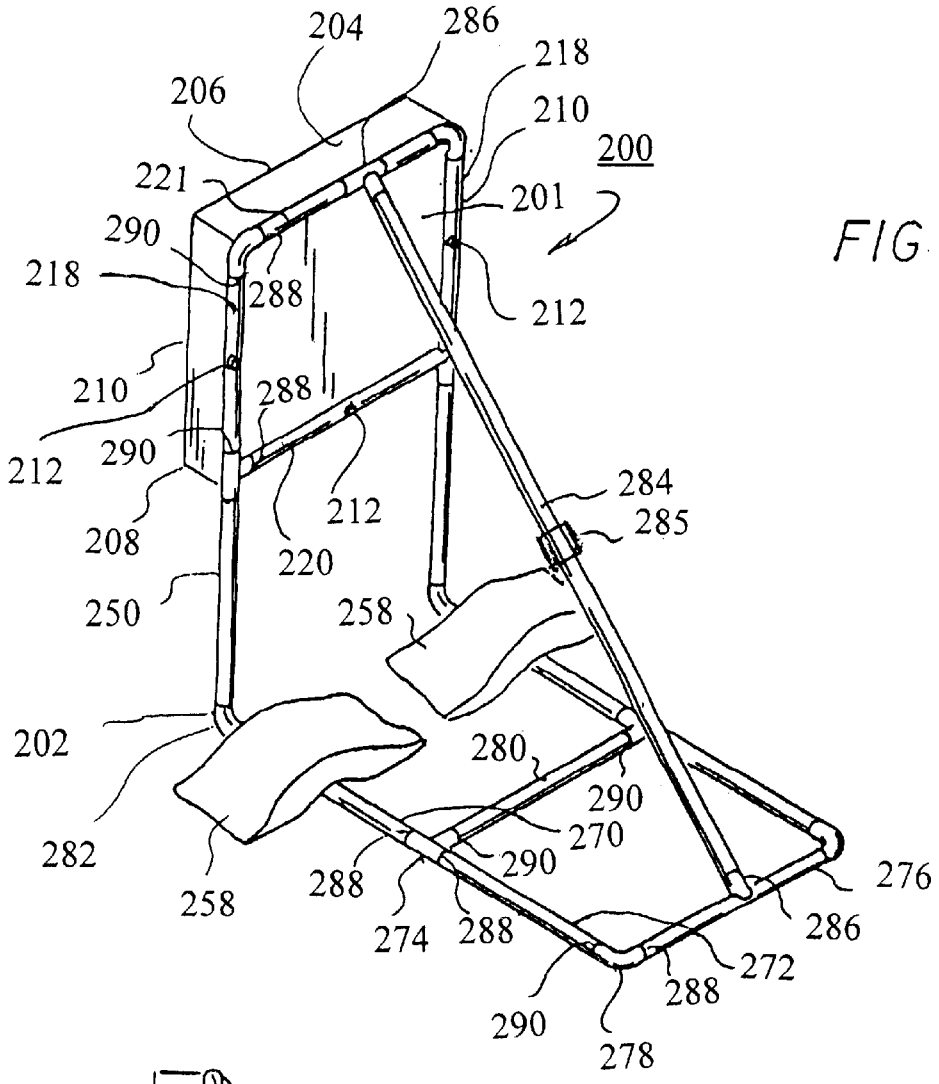
FIGS. 11 and 12 illustrate a final embodiment of the invention.
Figure 12:
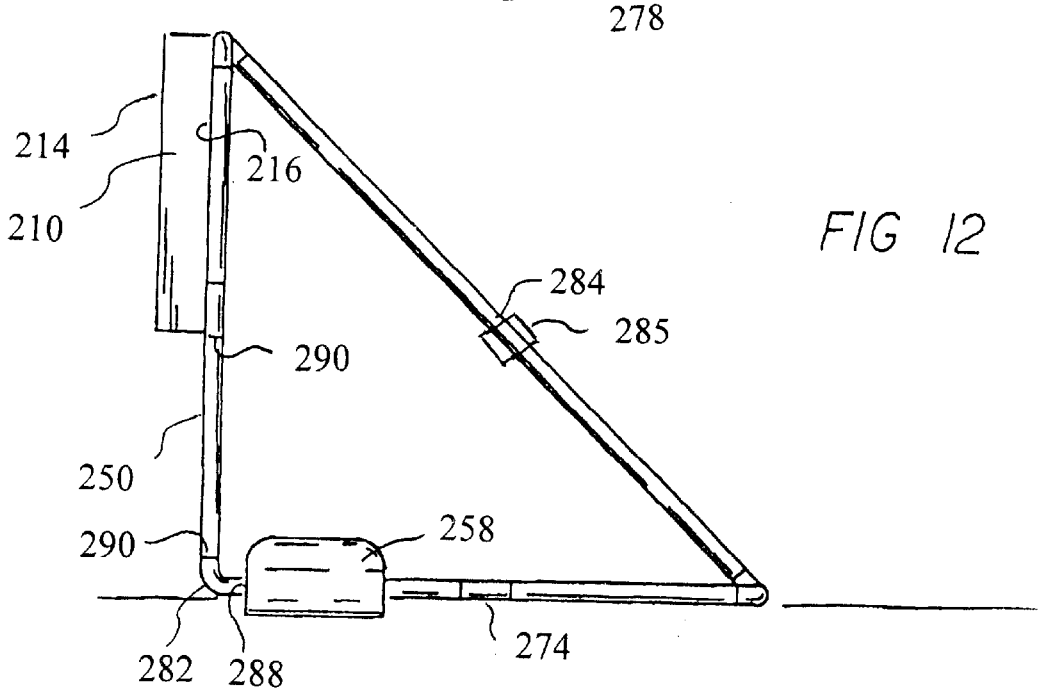

A final embodiment of the invention is disclosed in system 200 of FIGS. 11 through 12. In such embodiment, the major difference is the utilization of a different type of base assembly 202. The target 204 of this final embodiment is a rectangular member, preferably square essentially similar to that as illustrated in FIGS. 5–8. The square has upper and lower horizontal edges 206, 208 in parallel relationship and, coupled there between are vertical side edges 210, parallel with respect to each other. The target has a thickness of at least 2 inches and preferably not greater than 4 inches. It may have any thickness between such 2 and 4 inchdimensions. The preferred material for the target is a commercially available polyfoam. The polyfoam is a generally rigid material with the characteristics that if an arrow is shot there through, the material of the target will return to its original orientation after removal of the arrow. As a result, long life is provided to the system through the use of this novel target material. Support of the target is effected through the utilization of three apertures 212 there through. The apertures extend from the front face 214 to the rear face 216 and have a constant diameter and length. The apertures are located in proximity to the central extents of the bottom and side edges of the target. The size of the target is such that the rear face will have its peripheral area in contact with the front faces of the upper rectangle of the pipes for maximum support. Targets of other shapes, such as rectangular, circular, oval, etc., could readily be utilized.

In order to effect the coupling of the target to the pipes, the pipes, including the upper side pipes 218 and the intermediate pipe 220, are formed with horizontal apertures there through adjacent to their midpoints. Such apertures are in axial alignment with the apertures of the target. The periphery of the target in contact with its associated pipes will effect a strong coupling upon being impacted by an arrow regardless of where the target is hit. The pipes are preferably hollow polyvinyl chloride (PVC), rigid, with a preferred diameter of about ¾ inches.

Coupling between the pipes and the target is effected through a coupling assembly as in the immediate prior embodiment. The coupling assembly includes a bolt having an enlarged head at one end with threads at the opposite ends. Associated with the threads is a wing nut for coupling and uncoupling purposes. The central extent of each bolt extends through an aperture of the target and the apertures of a pipe, all three in a like manner. Only one is shown in FIG. 8. In association therewith, there is preferably provided a sleeve. The sleeve is preferably of stainless steel for long life and is a length essentially equal to the length of the thickness of the target and extends there through. The forward end of the sleeve is provided with a flange adapted to contact the front face of the target. In addition, a pair of washers are employed. One washer is between the head of the bolt and the flange of the sleeve. The other washer is between the wing nut and the associated pipe. The length of the sleeve is equal to the length of thickness of the target and the outside diameter of the sleeve is equal to the inside diameter of the hole in the target. This functions to prevent the bolt from tearing the target.

The base assembly of the system 200 of the final embodiment includes an interior horizontal pipe 270 and an exterior horizontal pipe 272 on each side in spaced parallel relationship. A T-shaped coupled 274 retains the horizontal pipes of each side in linear relationship. An end horizontal cross pipe 276 couples the ends of the exterior horizontal pipes. Elbows 278 effect the coupling therebetween. An intermediate horizontal cross piece 280 couples the interior and exterior horizontal pipes through the T-shaped couplers 274. Elbows 282 at the interior ends of the interior horizontal pipes couple to the vertical pipes 250. A central brace 284 has a lower end removably affixed to a lower attachment component 286 which is, in turn, fixedly secured, preferably by glue, to the center of the end horizontal cross piece 276. The upper end of the central brace 284 is removably affixed to an upper attachment component 286 which is in turn fixedly secured, preferably by glue, to the center of the upper horizontal pipe 221 which receives the target 201. The central brace constitutes an effective hypotenuse of an isosceles right triangle with angles of about 45 degrees with the horizontal and vertical pipes. Note FIG. 12. This relationship provides maximum stability.

The target is preferably fashioned of a close cell foam, an OBE foam, with a 6 pound density. Such material is commercially available in black or white from American Foam Products, Inc. of Painesville, Ohio. The front and/or back may be provided with a target, as for example a deer, a bulls eye, or the like. The target is then preferably bounded by a metal periphery.

Convenience for assembling and disassembling is enhanced by gluing various components with respect to each other and leaving the other components unglued for fitting together prior to use and for unfitting to achieve disassembly prior to storage. Reference numeral 288 refers to glued connections while reference numeral 290 refers to unglued connections which allow for separation for storage and transportation purposes, preferably in association with the storage bag 162.

The long diagonal PVC pipe 184 is preferably formed of two sections of essentially equal length with a ¾ inch PVC joint coupling 185 securing the sections together. The lower end of the upper section is glued to the top end of the joint coupling while the upper end of the lower section is separably received in the lower end of the joint coupling. This maximizes a secure coupling during operation and use while allowing convenient separation for storage and transportation.

Another additional aspect of the invention is the utilization of sandbags 258. The sandbags are preferably located in contact with the upper surface of the forward horizontal pipes. Note FIGS. 11 and 12. In this manner, impact of the target by an arrow will preclude the target from tipping over during operation and use. It is preferred that the sandbags are filled with sand, not rocks or other debris.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable target stand and target for target practice comprising in combination:

an upper rectangular support fabricated of polyvinyl chloride pipes including two vertical pipes and a lower horizontal pipe and an upper horizontal pipe in a rectangular configuration;

a target fabricated of polyfoam in a square configuration with a thickness of about between 2 and 4 inches;

a plurality of holes through the target with each hole having a stainless steel sleeve with a flange on one end for positioning over the front face of the target;

each of the pipes being fabricated of hollow ¾-inch polyvinyl chloride with a central aperture through each vertical pipe and the lower horizontal pipe for alignment with holes in the target and with bolts for coupling purposes;

a bag with an opening at one end and a tie string there adjacent, the bag adapted to receive and support the frame when disassembled for storage and transportation purposes;

a base assembly including an interior horizontal pipe and an exterior horizontal pipe on each side in spaced parallel relationship, a T-shaped coupler retaining the horizontal pipes of each side in linear relationship, an end horizontal cross pipe coupling the ends of the exterior horizontal pipes with elbows effecting the coupling therebetween, an intermediate horizontal cross piece coupling the interior and exterior horizontal pipes through T-shaped couplers with elbows at the interior ends of the interior horizontal pipes coupling to the vertical pipes, a central brace having a lower end removably affixed to a lower attachment component which is, in turn, fixedly secured, preferably by glue, to the center of the end horizontal cross piece with the upper end of the central brace removably affixed to an upper attachment components which is in turn fixedly secured to the center of the upper horizontal pipe which receives the target with the central brace constituting an effective hypotenuse of an isosceles right triangle with angles of about 45 degrees with the horizontal and vertical pipes, and a pair of sand bags positionable on a forward extent and a rearward extent of the interior horizontal pipe and the exterior horizontal pipe to preclude inadvertent tipping of the support and target.

2. A portable target stand and target system for target practice comprising:

an upper rectangular support fabricated of two polyvinyl chloride horizontal pipes and two polyvinyl chloride vertical pipes in a rectangular configuration;

a target in a square configuration;

a plurality of holes through the target with each hole having a sleeve with a flange on one end for positioning over the front face of the target;

each of the pipes of the upper rectangular support being fabricated of hollow polyvinyl chloride with a central aperture through each vertical pipe and the lower horizontal pipe for alignment with holes in the target and with bolts for coupling purposes;

a base assembly including an interior horizontal pipe and an exterior horizontal pipe on each side in spaced parallel relationship, a T-shaped coupler retaining the horizontal pipes of each side in linear relationship, an end horizontal cross pipe coupling the ends of the exterior horizontal pipes with elbows effecting the coupling therebetween, an intermediate horizontal cross piece coupling the interior and exterior horizontal pipes through T-shaped couplers with elbows at the interior ends of the interior horizontal pipes coupling to the vertical pipes, a central brace having a lower end removably affixed to a lower attachment component which is, in turn, fixedly secured to the center of the end horizontal cross piece with the upper end of the central brace removably affixed to an upper attachment component which is in turn fixedly secured to the center of the upper horizontal pipe which receives the target with the central brace constituting an effective hypotenuse of a triangle.

3. The system as set forth in claim 2 and further including a pair of sand bags positionable on an forward extent and rearward extent of a horizontal base to preclude inadvertent tipping of a support and target.

4. The system as set forth in claim 2 and further including a bag with an opening at one end and a tie string there adjacent, the bag adapted to receive and support a frame when disassembled for storage and transportation purposes.

* * * * *